US008844673B2

(12) United States Patent
Kainuma

(10) Patent No.: US 8,844,673 B2
(45) Date of Patent: Sep. 30, 2014

(54) MUFFLER FOR INTERNAL COMBUSTION ENGINE

(75) Inventor: Katsuhiko Kainuma, Okazaki (JP)

(73) Assignee: Futaba Industrial Co., Ltd. (JP)

( * ) Notice: Subject to any disclaimer, the term of this patent is extended or adjusted under 35 U.S.C. 154(b) by 0 days.

(21) Appl. No.: 13/576,579

(22) PCT Filed: Feb. 1, 2011

(86) PCT No.: PCT/JP2011/052021

§ 371 (c)(1),
(2), (4) Date: Aug. 1, 2012

(87) PCT Pub. No.: WO2011/093507

PCT Pub. Date: Aug. 4, 2011

(65) Prior Publication Data

US 2012/0305330 A1 Dec. 6, 2012

(30) Foreign Application Priority Data

Feb. 1, 2010 (JP) ..... 2010-020311

(51) Int. Cl.
*F01N 1/08* (2006.01)

(52) U.S. Cl.
CPC ..... *F01N 1/083* (2013.01); *F01N 2470/02* (2013.01); *F01N 1/085* (2013.01); *F01N 2470/30* (2013.01); *F01N 1/086* (2013.01); *F01N 1/084* (2013.01)
USPC ..... 181/265; 181/253

(58) Field of Classification Search
USPC ..... 181/227, 228, 253, 265, 268, 275
See application file for complete search history.

(56) References Cited

U.S. PATENT DOCUMENTS

| | | | | | |
|---|---|---|---|---|---|
| 3,672,464 | A | | 6/1972 | Rowley et al. | |
| 4,192,401 | A | * | 3/1980 | Deaver et al. | 181/266 |
| 4,235,304 | A | * | 11/1980 | Suyama | 181/265 |
| 4,267,899 | A | * | 5/1981 | Wagner et al. | 181/272 |
| 4,359,135 | A | * | 11/1982 | Wagner et al. | 181/266 |
| 4,360,076 | A | | 11/1982 | Suyama | |
| 4,361,206 | A | * | 11/1982 | Tsai | 181/255 |
| 4,632,216 | A | * | 12/1986 | Wagner et al. | 181/255 |

(Continued)

FOREIGN PATENT DOCUMENTS

| | | |
|---|---|---|
| JP | 49041223 | 11/1974 |
| JP | 52143551 | 10/1977 |

(Continued)

OTHER PUBLICATIONS

International Search Report dated Mar. 15, 2011, issued in PCT Patent Application No. PCT/JP2011/052021, 2 pages.
Written Opinion dated Feb. 14, 2012, issued in PCT Patent Application No. PCT/JP2011/052021, 5 pages.
Preliminary Report on Patentability dated May 14, 2012 issued in PCT Patent Application No. PCT/JP2011/052021, 4 pages.

(Continued)

*Primary Examiner* — Jeremy Luks
(74) *Attorney, Agent, or Firm* — Grossman Tucker Perreault & Pfleger PLLC

(57) ABSTRACT

A muffler for an internal combustion engine includes an outer shell, an inlet pipe, an outlet pipe, and at least one constricted part. The at least one constricted part is provided in at least one of the inlet pipe and the outlet pipe on an open side thereof opening toward an inside of the outer shell. The at least one constricted part has a cross-sectional area smaller than a cross-sectional area of the at least one of the inlet pipe and the outlet pipe, which is provided with the at least one constricted part.

8 Claims, 4 Drawing Sheets

(56) References Cited

U.S. PATENT DOCUMENTS

| | | | | |
|---|---|---|---|---|
| 4,690,245 | A * | 9/1987 | Gregorich et al. | 181/272 |
| 5,426,269 | A * | 6/1995 | Wagner et al. | 181/232 |
| 6,354,398 | B1 * | 3/2002 | Angelo et al. | 181/256 |
| 7,174,992 | B2 * | 2/2007 | Kicinski | 181/255 |
| 2005/0224283 | A1 * | 10/2005 | Yokoi et al. | 181/268 |
| 2009/0272601 | A1 * | 11/2009 | Hagiwara | 181/249 |

FOREIGN PATENT DOCUMENTS

| | | |
|---|---|---|
| JP | 60095110 | 6/1985 |
| JP | 61184808 | 11/1986 |
| JP | 2001159304 | 6/2001 |
| JP | 2001221043 | 8/2001 |
| JP | 2003314240 | 11/2003 |

OTHER PUBLICATIONS

PCT Written Opinion dated Aug. 1, 2012 issued in PCT Patent Application No. PCT/JP2011/052021 with partial English language translation, 4 pages.

PCT Preliminary Report on Patentability dated Oct. 11, 2012 issued in in PCT Patent Application No. PCT/JP2011/052021, 6 pages.

PCT Written Opinion dated Mar. 15, 2011 issued in PCT Patent Application No. PCT/JP2011/052021 with partial English language translation, 4 pages.

Chinese language dated Feb. 28, 2014 issued in Chinese Patent Application No. 201180007923.4. English language translation provided, 17 pages.

Japanese Office Action dated Mar. 11, 2014, issued in Japanese Patent Application No. 2010-020311. English language translation provided, 6 pages.

* cited by examiner

MUFFLER FOR INTERNAL COMBUSTION ENGINE

CROSS-REFERENCE TO RELATED APPLICATIONS

This international application claims the benefit of Japanese Patent Application No. 2010-020311 filed Feb. 1, 2010 in the Japan Patent Office, and the entire disclosure of Japanese Patent Application No. 2010-020311 is incorporated herein by reference.

TECHNICAL FIELD

The present invention relates to a muffler for an internal combustion engine, which is provided in an exhaust-gas flow path in the internal combustion engine to reduce exhaust noise.

BACKGROUND ART

Conventionally, as disclosed in Patent Document 1, in an exhaust-gas flow path of an internal combustion engine, an exhaust manifold, a catalytic converter, a sub muffler, a main muffler, and a tail pipe are disposed in the exhaust-gas flow path and installed in a space under a floor of a vehicle.

In the space under the floor of the vehicle, not only devices of exhaust system, but also many components of the vehicle, such as a propeller shaft, a cross member, a side member, a fuel tank, and others, are provided. For this reason, since the space under the floor is limited, a length of each of exhaust pipes to be connected to a muffler is determined in accordance with an arrangement of the muffler.

Exhaust noise generally includes explosion noise inside a cylinder(s) of an internal combustion engine, gas-flow noise generated by a flow of exhaust gases, a standing wave generated by air-column resonance due to lengths of exhaust pipes, and so on. In this regard, depending on lengths of exhaust pipes, silencing performance with respect to a low-frequency noise may be deteriorated because of an influence of the standing wave generated within each of these exhaust pipes. The low-frequency noise causes a muffled sound inside a vehicle, and this muffled sound is a factor of giving an uncomfortable feeling to a passenger in the vehicle. In order to suppress the muffled sound, a main muffler with a large capacity or a sub muffler is used.

For example, as shown in FIG. 4A, in a case where a length of an exhaust pipe 102 connected to a downstream side of a main muffler 100 is long and therefore, a standing wave caused by air-column resonance of harmful low-frequency waves is generated in the exhaust pipe 102, a resonant frequency is increased to a frequency which does not pose a problem by increasing the capacity of the main muffler 100 or disposing a sub muffler 104 somewhere within the length of the exhaust pipe 102 to shorten an actual length of the exhaust pipe 102, as shown in FIG. 4B.

When an amount of noise reduction is increased by increasing the capacity of the main muffler 100 or additionally providing the sub muffler 104, peaks in sound pressure level due to the standing wave decrease and the overall sound pressure level also decreases, as shown by the solid line in FIG. 4C. The broken line in FIG. 4C shows a relationship between a number of rotation of an internal combustion engine and sound pressure level, in a case where a sub muffler is not disposed. In FIG. 4C, a vertical axis shows the sound pressure level, and a horizontal axis shows the number of rotation of the internal combustion engine.

PRIOR ART DOCUMENTS

Patent Documents

Patent Document 1: Japanese Unexamined Patent Application Publication No. 2001-221043

SUMMARY OF THE INVENTION

Problems to be Solved by the Invention

However, in the above conventional muffler for an internal combustion engine, the following problems arise: when the main muffler has a large capacity or the sub muffler is additionally provided, a weight of the device constituting the exhaust-gas system increases or a layout within the space under the floor is significantly affected.

An object of the present invention is to provide a muffler for an internal combustion engine, with which the weight increase and the influence on the layout can be suppressed.

Means for Solving the Problems

In order to achieve the above object, a muffler for an internal combustion engine of the present invention includes: an outer shell; an inlet pipe which is enclosed in the outer shell and into which exhaust gases discharged from the internal combustion engine are introduced; an outlet pipe which is enclosed in the outer shell and which discharges the exhaust gases; and at least one constricted part provided in at least one of the inlet pipe and the outlet pipe on an open side thereof opening toward an inside of the outer shell, the at least one constricted part having a cross-sectional area smaller than a cross-sectional area of the at least one of the inlet pipe and the outlet pipe, which is provided with the at least one constricted part.

When the muffler for an internal combustion engine is constituted as explained above, the at least one of the inlet pipe and the outlet pipe, which is provided with the at least one constricted part, may include a tapered part with a diameter decreasing toward the at least one constricted part. Also, the at least one of the inlet pipe and the outlet pipe, which is provided with the at least one constricted part, may be provided with a small bore which opens inside the outer shell. Moreover, the outlet pipe may include a straight part provided to connect with the tapered part, and a small bore may be formed on the straight part. Furthermore, when the at least one constricted part is provided in the outlet pipe on an open side thereof opening toward the inside of the outer shell, a flared part may be provided at an opening end, which is located inside the outer shell, of the outlet pipe; the flared part has a diameter increasing from the at least one constricted part toward the inside of the outer shell.

Effects of the Invention

In the muffler for an internal combustion engine of the present invention, the at least one constricted part makes it possible to inhibit a sound reflection from reflecting in an uniform direction. Consequently, the muffler for an internal combustion engine of the present invention exhibits the following effects: it is possible to reduce generation of the standing wave, reduce exhaust noise without introducing a large capacity and weight increase, and to reduce increase of the weight as well as influence on the layout.

Moreover, in the muffler for an internal combustion engine provided with the tapered part, it is possible to inhibit a sound reflection from reflecting in an uniform direction with respect to a wider range, in the at least one of the inlet pipe and the outlet pipe. Consequently, exhaust noise can be reduced in the tapered part as well, without introducing a large capacity and weight increase. Moreover, by providing the tapered part, an area where a constricted part is to be formed can be localized; thus, pressure loss (inlet loss) in the constricted part can be minimized. Furthermore, in the muffler for an internal combustion engine provided with the small bore, exhaust noise can be reduced by the small bore as well without introducing a large capacity and weight increase. Also, by providing the flared part, it becomes possible to inhibit occurrence of a turbulent flow of exhaust gases in the constricted part. Thus, increase of pressure loss resulting from provision of the constricted part can be reduced.

EXPLANATION OF REFERENCE NUMERALS

1 . . . outer shell, 2 . . . tube part, 4,6 . . . sidewall part, 8,10,36 . . . partition wall, 12 . . . first expansion chamber, 13 . . . second expansion chamber, 14 . . . third expansion chamber, 16 . . . inlet pipe, 22 . . . outlet pipe, 24, 32 . . . constricted part, 26,34 . . . tapered part, 27 . . . straight part, 28 . . . flared part, 30 . . . small bore, 38 . . . resonant chamber, 60 . . . internal combustion engine, 70 . . . muffler for internal combustion engine

MODE FOR CARRYING OUT THE INVENTION

Hereinafter, an embodiment for carrying out the present invention will be described in detail with reference to the drawings.

Figure 1:
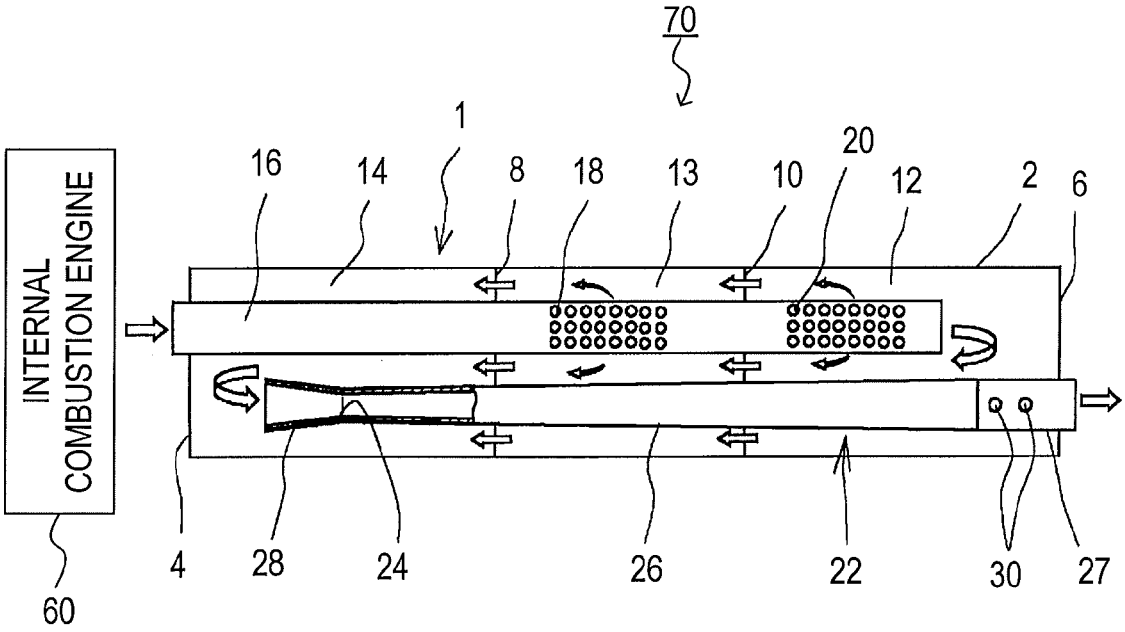
FIG. 1 is a view showing a schematic configuration of a muffler for an internal combustion engine as one embodiment of the present invention.

As shown in FIG. 1, a muffler 70 for an internal combustion engine is provided with an outer shell 1, an inlet pipe 16, and an outlet pipe 22.

The outer shell 1 includes a cylindrical tube part 2, and sidewall parts 4 and 6. The sidewall parts 4 and 6 close both ends of the tube part 2. The outer shell 1 is formed to have a hollow thereinside.

Inside the hollow of the outer shell 1, partition walls 8 and 10 are provided. The tube part 2 is divided by the partition walls 8 and 10 into a plurality of a first expansion chamber 12 to a third expansion chamber 14.

The inlet pipe 16 penetrates through the sidewall part 4 at one side of the outer shell 1 and is inserted into the hollow. The inlet pipe 16 penetrates through the partition walls 8 and 10 to pass through inside the third expansion chamber 14 and the second expansion chamber 13; consequently, one end of the inlet pipe 16 is located within the first expansion chamber 12. This one end of the inlet pipe 16, which is located within the first expansion chamber 12, has an opening. In each of the partition walls 8 and 10, not-shown multiple holes are formed, so that the first expansion chamber 12 to the third expansion chamber 14 are communicated to one another.

Multiple through holes 18 are bored in a part, which is located within the second expansion chamber 13, of an outer circumference of the inlet pipe 16. Also, multiple though holes 20 are bored in a part, which is located within the first expansion chamber 12, of the outer circumference of the inlet pipe 16. The other end of the inlet pipe 16 is connected to a not-shown upstream exhaust pipe, so as to introduce exhaust gases from an internal combustion engine 60 into the inlet pipe 16.

The outlet pipe 22 penetrates through the sidewall part 6 at the other side of the outer shell 1 and is inserted into the hollow. The outlet pipe 22 penetrates through the partition walls 8 and 10 to pass through the first expansion chamber 12 and the second expansion chamber 13; consequently, one end of the outlet pipe 22 is located within the third expansion chamber 14. This one end, which is located within the third expansion chamber 14, of the outlet pipe 22 (hereinafter, referred to as upstream end) has an opening. The other end of the outlet pipe 14 (hereinafter, referred to as downstream end) is connected to a not-shown downstream exhaust pipe, so as to discharge the exhaust gases from the internal combustion engine 60.

In the upstream end of the outlet pipe 22, a constricted part 24 is formed. The constricted part 24 has a cross-sectional area smaller than cross-sectional areas in other parts of the outlet pipe 22. The cross-sectional area of the constricted part 24 may be determined in an appropriate manner by experiments, etc., depending on silencing performance.

The outlet pipe 22 includes a tapered part 26 which has a diameter decreasing from the downstream end toward the constricted part 24. The tapered part 26 is provided within the outer shell 1. The tapered part 26 in the present embodiment is formed to have a length from the constricted part 24 to a vicinity of the sidewall part 6 at the other side (i.e., the downstream end). The outlet pipe 22 also includes a straight part 27 provided to connect with the tapered part 26. The downstream exhaust pipe is connected to the straight part 27. Here, the downstream exhaust pipe may be connected to the tapered part 26 without the straight part 27.

A flared part 28 is formed from the constricted part 24 on a side opposite from a side where the tapered part 26 is provided. The flared part 28 is formed in a tapered manner such that a diameter of the flared part 28 gradually increases from the constricted part 24. An end of the flared part 28 has an opening within the third expansion chamber 14.

In an outer circumference of the outlet pipe 22, small bores 30 are formed on a side where the sidewall part 6 is provided. The small bores 30 are formed in the straight part 27 and are provided so as to open within the first expansion chamber 12.

In the muffler 70 for the internal combustion engine, when the internal combustion engine 60 is operated at a predetermined number of rotation per unit time, a standing wave is generated in the outlet pipe 22 and in a downstream-side connection pipe connected to the outlet pipe 22, depending on a wavelength of sound generated at the aforementioned number of rotation and also on lengths of the outlet pipe 22 and of the downstream-side connection pipe connected to the outlet pipe 22. In the standing wave generated at this time, nodes are formed in the constricted part 24. In the standing wave, there exists multiple components such as a primary component, a secondary component, etc., depending on the number of rotation per unit time of the internal combustion engine 60 (here, a lowest frequency at which a standing wave is generated is the primary component). It is preferable to form the small bores 30, at positions corresponding to anti-nodes (at positions where a pressure is high) of the aforementioned standing wave or in a vicinity of these positions. The small bores 30 are preferably configured to have an opening area which is equal to or less than one-fifth of a cross-sectional area of the outlet pipe 22. In the case that a plurality of small bores 30 are provided, a total opening area of the plurality of small bores 30 is preferably equal to or less than one-fifth of the cross-sectional area of the outlet pipe 22. As a result of forming the small bores 30, apparent anti-nodes in the standing wave are not formed at a location of the constricted part 24.

Next, explanations are given with respect to a flow of exhaust gases within the muffler 70 for the internal combustion engine in the above-explained present embodiment.

When exhaust gases from the internal combustion engine 60 are introduced into the inlet pipe 16, part of the exhaust gases, which are flowing within the inlet pipe 16, flow into the second expansion chamber 13 via the though holes 18. Moreover, another part of the exhaust gases flow into the first expansion chamber 12 via the though holes 20. Furthermore, the exhaust gases from the internal combustion engine 60 flow into the first expansion chamber 12 via the opening at the one end of the inlet pipe 16. The exhaust gases which have flown into the first expansion chamber 12 flow into the second expansion chamber 13 via the not-shown holes in the partition wall 10.

The exhaust gases which have flown into the second expansion chamber 13 flow into the third expansion chamber 14 via the not-shown holes in the partition wall 8, and then flow into the flared part 28 of the outlet pipe 22 from the third expansion chamber 14. Inside the outlet pipe 22, the exhaust gases flow from the flared part 28 through the constricted part 24, and pass through the tapered part 26. Then, the exhaust gases are discharged from the outlet pipe 22 to the downstream exhaust pipe.

In a conventional muffler for an internal combustion engine, when a length of the downstream exhaust pipe is long, a standing wave is generated in the outlet pipe and also in the downstream exhaust pipe. The standing wave is generated as a result of synthesizing two waves: a wave generated due to flowing of the exhaust gases inside the outlet pipe and the downstream exhaust pipe (hereinafter, referred to as exhaust wave), and a reflection wave which is the exhaust wave reflecting along an axial direction of the outlet pipe and the downstream exhaust pipe.

However, in the muffler 70 for the internal combustion engine, when the constricted part 24 and the tapered part 26 are provided, an end part of the outlet pipe 22 is made to be narrowed. Therefore, the exhaust wave reflecting along the axial direction of the outlet pipe 22 and the downstream exhaust pipe is reduced. Consequently, the muffler 70 for the internal combustion engine can inhibit generation of the reflection wave which is a factor of generation of a resonance phenomenon; therefore, the muffler 70 for the internal combustion engine can also reduce a sound pressure of a sound generated due to the flowing of the exhaust gases inside the outlet pipe 22 and the downstream exhaust pipe. Here, the muffler for an internal combustion engine of the present invention can be implemented, without forming the tapered part 26, by providing a cap on an open side of the straight-shaped outlet pipe 22 and forming a hole in the cap, thereby constituting the constricted part 24. By providing the tapered part 26, the constricted part 24 is formed in a localized manner, thereby making it possible to minimize increase of pressure loss.

Moreover, since the tapered part 26 is provided to connect with the constricted part 24 in the outlet pipe 22, the tapered part 26 inhibits generation of the reflection wave which increases a pressure loss and which causes generation of a resonance phenomenon, thereby reducing a sound pressure of the standing wave. If the length of the tapered part 26 is long, an effect of the aforementioned reduction is greater; it is preferable that the length of the tapered part 26 is about one-fourth of a wavelength of a primary component.

Furthermore, the small bores 30 formed in the outer circumference of the outlet pipe 22 make it possible to reduce a phenomenon of air-column resonance caused by the standing wave. That is, when the internal combustion engine 60 is decelerated, exhaust gases flow out to the first expansion chamber 12 via the small bores 30, thereby reducing the sound pressure of the standing wave. When the internal combustion engine 60 is accelerated, exhaust gases flow into the outlet pipe 22 via the small bores 30 from the first expansion chamber 12, thereby inhibiting generation of the reflection wave. Moreover, the small bores 30 have an effect of inhibiting increase of a pressure loss, which is caused by the constricted part 24, at the time of acceleration.

The flared part 28 inhibits occurrence of a turbulent flow of the exhaust gases flowing into the outlet pipe 22 from the third expansion chamber 14. Also, the flared part 28 reduces increase of a pressure loss in the exhaust gases flowing into the outlet pipe 22, especially, a pressure loss when a flow amount of the exhaust gases is increased at the time of acceleration, etc.

Figure 2:
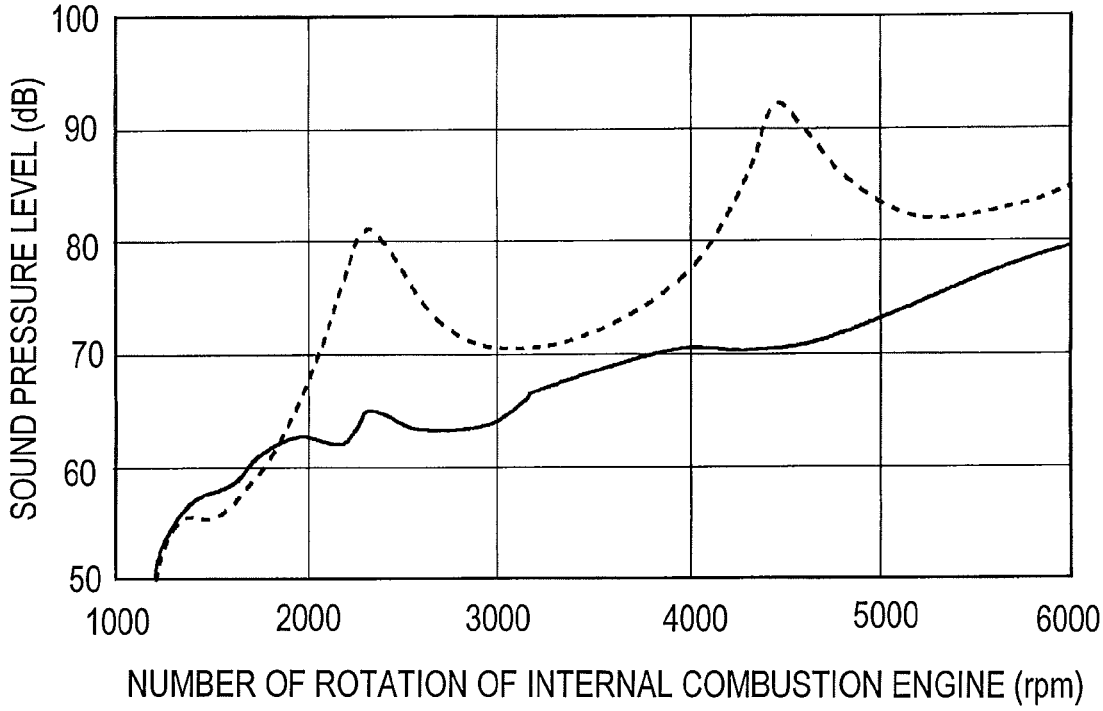
FIG. 2 is a graph showing, in the muffler for the internal combustion engine of the embodiment, a relationship between a number of rotation of the internal combustion engine and sound pressure level.

In FIG. 2, a solid line shows, in the muffler 70 for the internal combustion engine of the present embodiment, a relationship between a number of rotation of the internal combustion engine and sound pressure level. A broken line in FIG. 2 shows a relationship between a number of rotation of an internal combustion engine and sound pressure level, in a conventional muffler in which the flared part 28, the constricted part 24, and the tapered part 26 are not provided. As shown in FIG. 2, the muffler 70 for the internal combustion engine of the present embodiment can reduce the sound pressure level at a number of rotation of the internal combustion engine, which corresponds to the primary component and the secondary component.

Figure 3A:
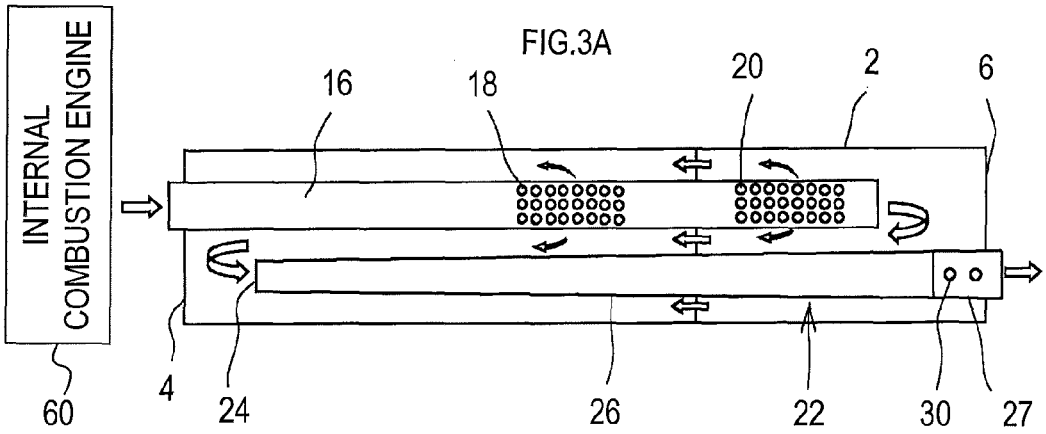
FIGS. 3A-3C are views each of which showing a schematic configuration of a muffler for an internal combustion engine as another embodiment.
Figure 3B:
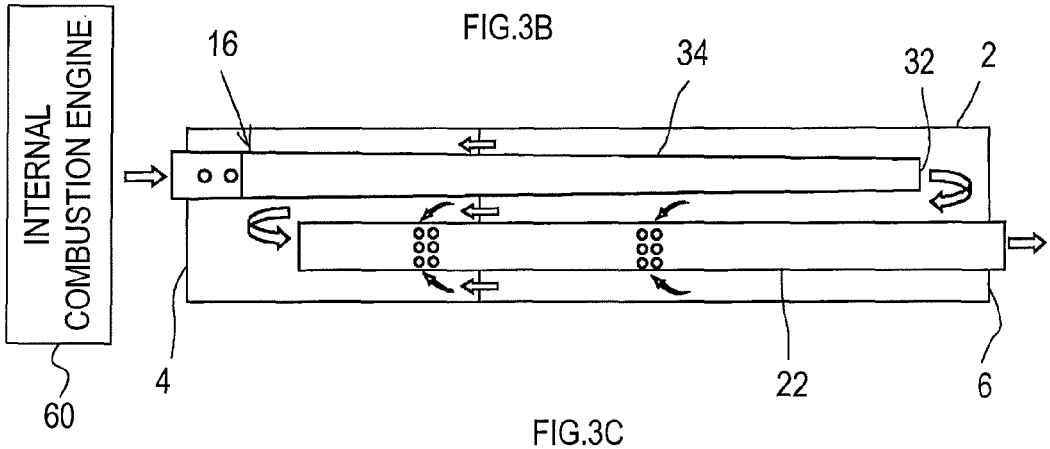

Moreover, the muffler for the internal combustion engine of the present invention can be implemented without the flared part 28, as shown in FIG. 3A. If a length of the upstream exhaust pipe is long and generation of the standing wave at the upstream side is a problem, the muffler for the internal combustion engine may be provided with, as shown in FIG. 3B, a constricted part 32 and a tapered part 34 in the inlet pipe 16. In this case, the constricted part 32 may be provided at an open side of the inlet pipe 16, opening toward an inside of the outer shell 1. The tapered part 34 may be formed to have a diameter decreasing from an end, which is to be connected to the internal combustion engine 60, of the inlet pipe 16 toward the constricted part 32.

Furthermore, in the muffler for the internal combustion engine, depending on respective lengths of the upstream and downstream exhaust pipes, both of the inlet pipe 16 and the outlet pipe 22 may be provided, respectively, with the constricted parts 24 and 32 and the tapered parts 26 and 34. Here, it is not necessary to provide the flared part 28 in the inlet pipe 16.

Figure 3C:
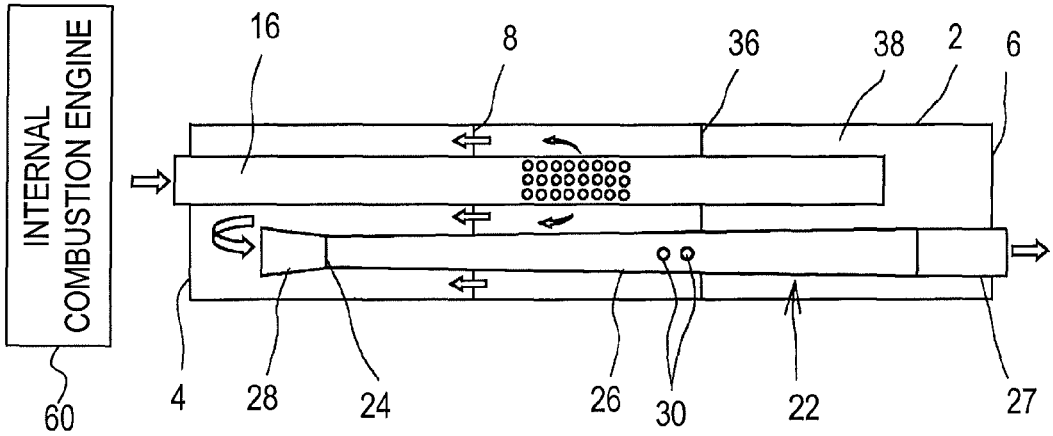
Figure 4A:
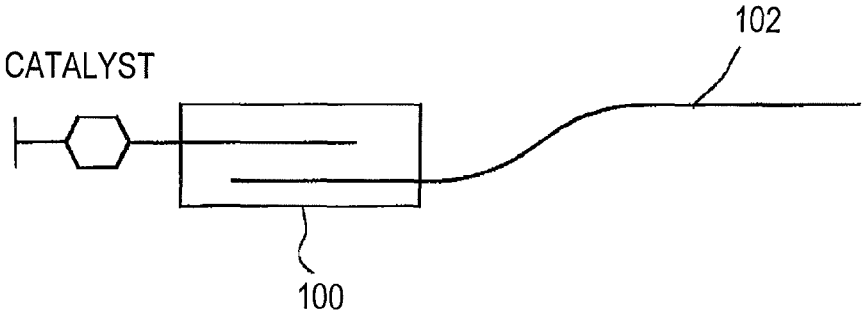
FIGS. 4A-4C are explanatory views of a conventional exhaust system.
Figure 4B:
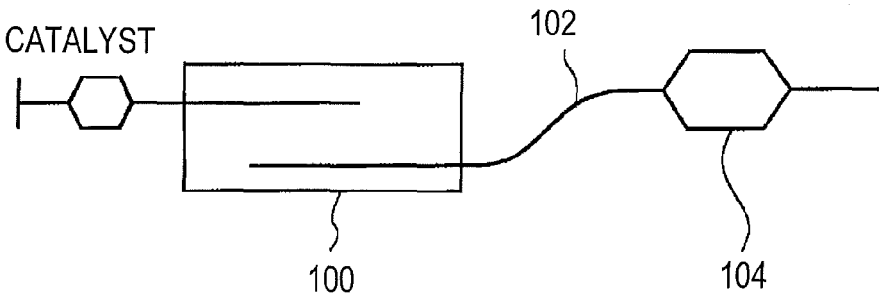
Figure 4C:
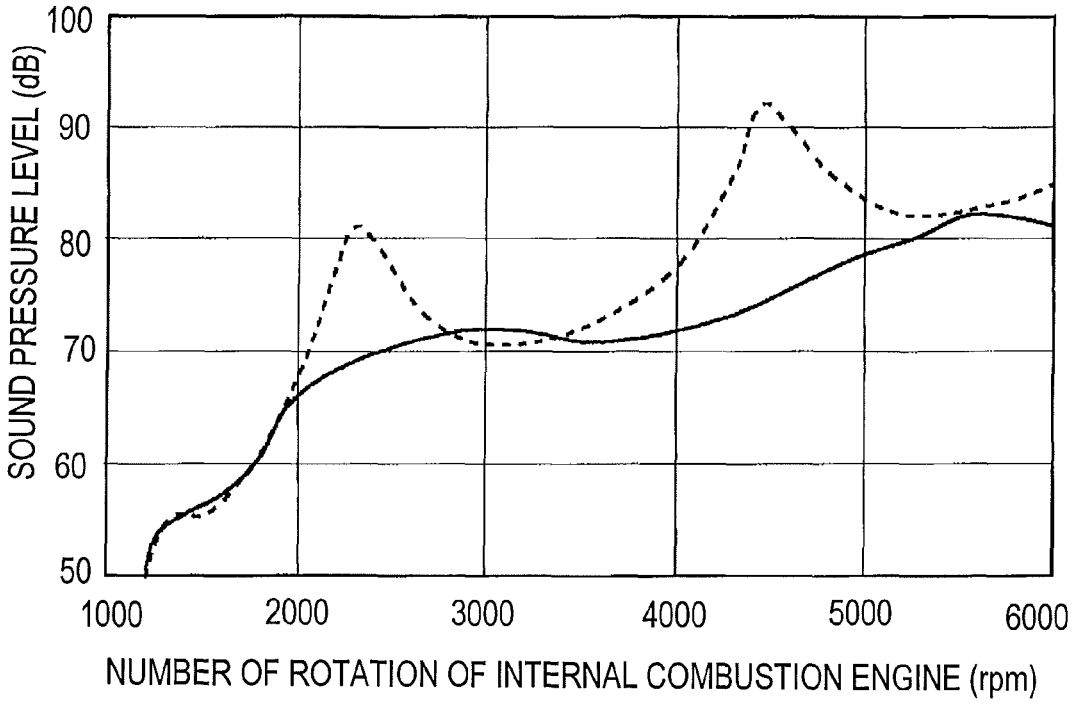

The above-mentioned embodiment has been explained with respect to an example in which only the expansion chambers are provided. However, the present invention is not limited to this embodiment, but can be configured as a muffler for an internal combustion engine, which is provided with a resonant chamber. As shown in FIG. 3C, the outer shell 1 is divided by the partition walls 8 and 36, thereby forming a resonant chamber 38. The outlet pipe 22 is disposed in such a manner to penetrate through the resonant chamber 38. The small bores 30 are to be formed outside the resonant chamber 38.

As above, the present invention should not be limited to the aforementioned embodiment, but can be implemented in various manners without departing from a gist of the present invention.

The invention claimed is:

1. A muffler for an internal combustion engine comprising:

an outer shell including a first and a second generally opposite end and at least one partition wall that divides an inner space of the outer shell into at least a first and a second chamber, wherein the first chamber is located at the first end of the outer shell;

an inlet pipe which is enclosed in the outer shell and into which exhaust gases discharged from the internal combustion engine are introduced, the inlet pipe extending from the first chamber towards the second end of the outer shell;

an outlet pipe which is enclosed in the outer shell and which discharges the exhaust gases;

a constricted part provided on an open side of the outlet pipe opening toward an inside of the outer shell, the constricted part having a cross-sectional area smaller than a cross-sectional area of the outlet pipe; and a tapered part which is provided in the outlet pipe and has a diameter increasing within the outer shell from the constricted part toward a downstream side of a flow path of the exhaust gases in the outlet pipe over the at least first and second chambers inside the outer shell;

wherein the inlet pipe and the outlet pipe are disposed such that an end part, from which the diameter starts increasing, of the tapered part is displaced from an extended line from a downstream end of the inlet pipe along an exhaust gas flow path inside the inlet pipe, and that the end part of the tapered part is located at an upstream side from the downstream end of the inlet pipe;

and wherein the end part of the tapered part is located in the first chamber.

2. The muffler according to claim 1, wherein a straight part is provided to connect with the tapered part on a downstream side of the flow path of the exhaust gases in the outlet pipe, and wherein the straight part is provided with at least one small bore which opens inside the outer shell.

3. The muffler according to claim 2, wherein an opening area of the at least one small bore is equal to or less than one-fifth of a cross-sectional area of the outlet pipe.

4. The muffler according to claim 2, wherein the at least one small bore is provided one of at a position corresponding to an anti-node of a standing wave and in a vicinity of the position corresponding to the anti-node of the standing wave.

5. The muffler according to claim 1, wherein the constricted part is provided on an open side of the outlet pipe opening toward an inside of the outer shell, and wherein a flared part is provided at an opening end, which is located inside the outer shell, of the outlet pipe, the flared part having a diameter increasing from the constricted part toward the inside of the outer shell.

6. The muffler according to claim 2, wherein the constricted part is provided on an open side of the outlet pipe opening toward an inside of the outer shell, and wherein a flared part is provided at an opening end, which is located inside the outer shell, of the outlet pipe, the flared part having a diameter increasing from the constricted part toward the inside of the outer shell.

7. The muffler according to claim 3, wherein the constricted part is provided on an open side of the outlet pipe opening toward an inside of the outer shell, and wherein a flared part is provided at an opening end, which is located inside the outer shell, of the outlet pipe, the flared part having a diameter increasing from the constricted part toward the inside of the outer shell.

8. The muffler according to claim 4, wherein the constricted part is provided on an open side of the outlet pipe opening toward an inside of the outer shell, and wherein a flared part is provided at an opening end, which is located inside the outer shell, of the outlet pipe, the flared part having a diameter increasing from the constricted part toward the inside of the outer shell.

* * * * *